United States Patent [19]

Selvage et al.

[11] Patent Number: 4,551,110

[45] Date of Patent: Nov. 5, 1985

[54] ROTATABLE CAM FOR USE IN A TOY CONSTRUCTION SET

[75] Inventors: Craig C. Selvage, Warwick, R.I.; Frank D. Ventura, Newburyport, Mass.

[73] Assignee: CPG Products Corp., Minneapolis, Minn.

[21] Appl. No.: 613,842

[22] Filed: May 24, 1984

[51] Int. Cl.[4] ..... A63H 33/12; A63H 33/04; A63H 33/06

[52] U.S. Cl. ..... 446/118; 446/122; 446/86; 403/348; 411/509; 411/349; 24/590

[58] Field of Search ..... 52/607, 127.9; 411/508, 411/509, 349, 553; 24/590, 591, 592, 593, 594, 606; 446/86, 111, 112, 113, 118, 122, 124, 125, 120, 127, 85; 269/900; 403/348, 349, 408

[56] References Cited

U.S. PATENT DOCUMENTS

| | | | |
|---|---|---|---|
| 1,680,289 | 8/1924 | Graeff | 403/348 X |
| 2,885,822 | 5/1959 | Onanian | 446/122 X |
| 3,195,266 | 7/1965 | Onanian | 446/86 |
| 3,220,078 | 11/1965 | Preziosi | 411/508 X |
| 3,659,376 | 5/1972 | Fischer | 446/112 |
| 3,954,344 | 5/1976 | Nakama | 411/508 X |
| 4,281,895 | 8/1981 | Mohr | 403/348 X |

*Primary Examiner*—Richard T. Stouffer
*Assistant Examiner*—D. Neal Muir
*Attorney, Agent, or Firm*—Gene O. Enockson; L. MeRoy Lillehaugen; Stuart R. Peterson

[57] ABSTRACT

The toy construction set includes a plurality of blocks and at least one base plate. Each of the blocks has one or more axially shiftable and rotatable coupling cams mounted therein which can be projected from the bottom of the block to effect vertical attachment with another block or with the base plate, using a suitable hand tool to do so. The preferred base plate contains a number of appropriately located coupling cams so that it can be attached either above or below a number of blocks.

23 Claims, 21 Drawing Figures

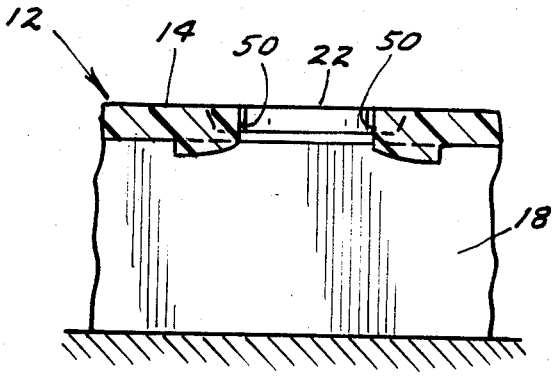
FIG. 7
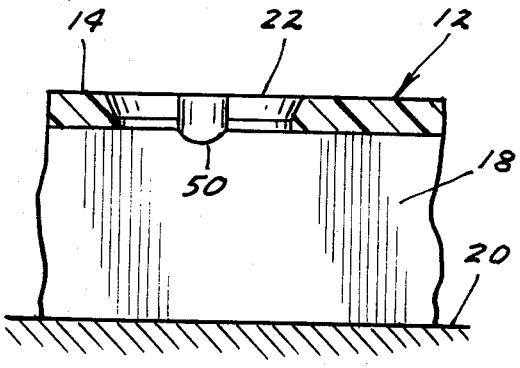
FIG. 8
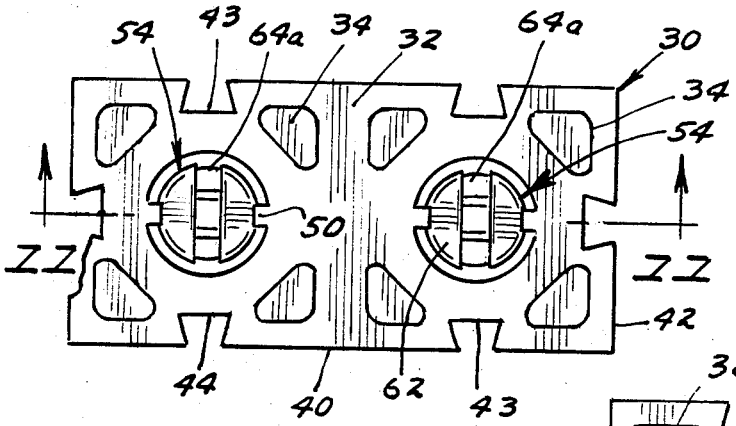
FIG. 9
FIG. 10
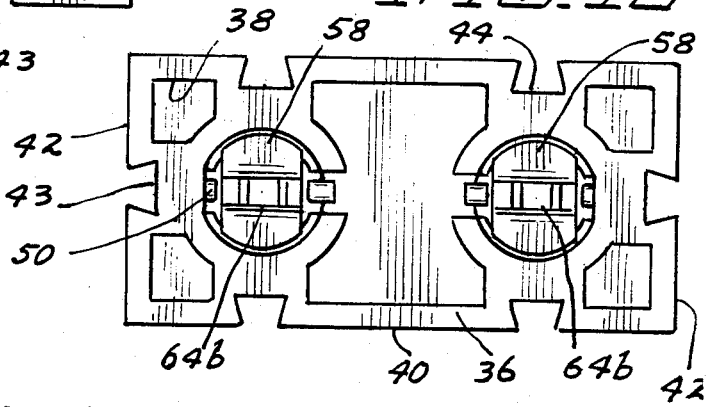
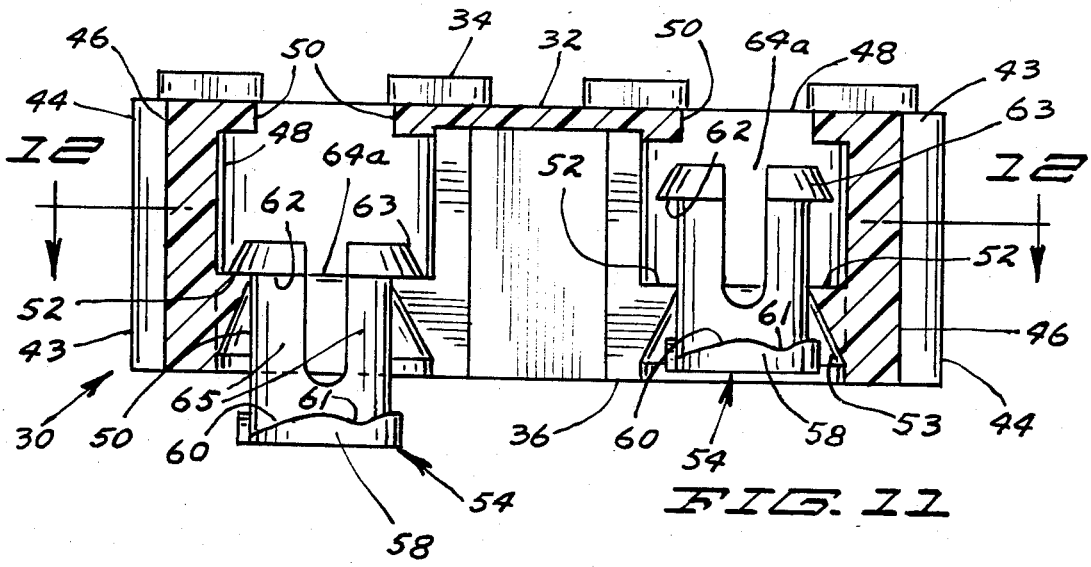
FIG. 11

FIG. 19
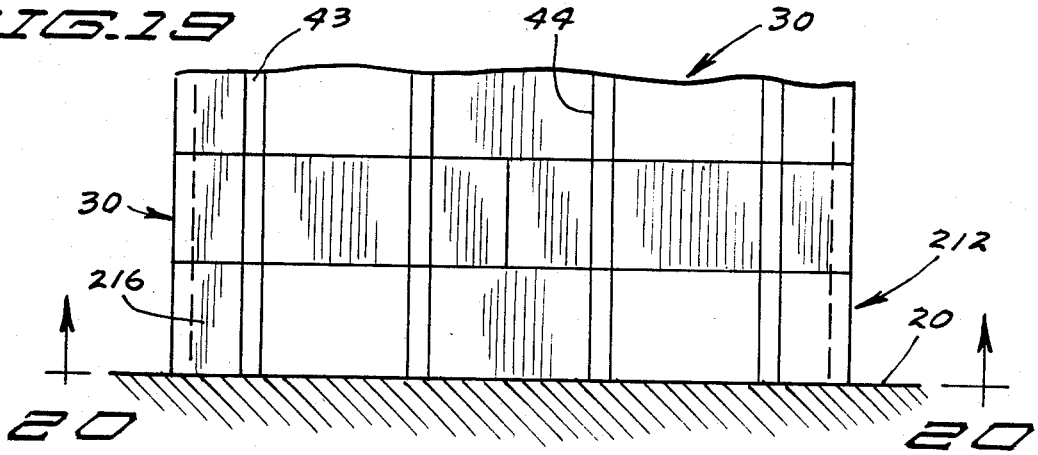
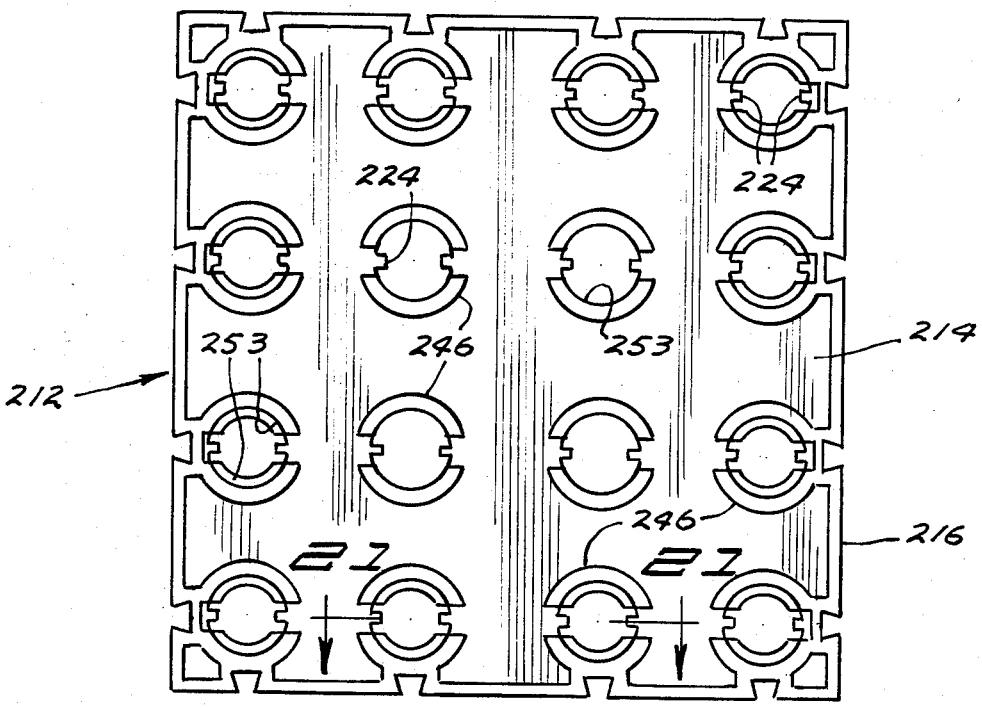
FIG. 20
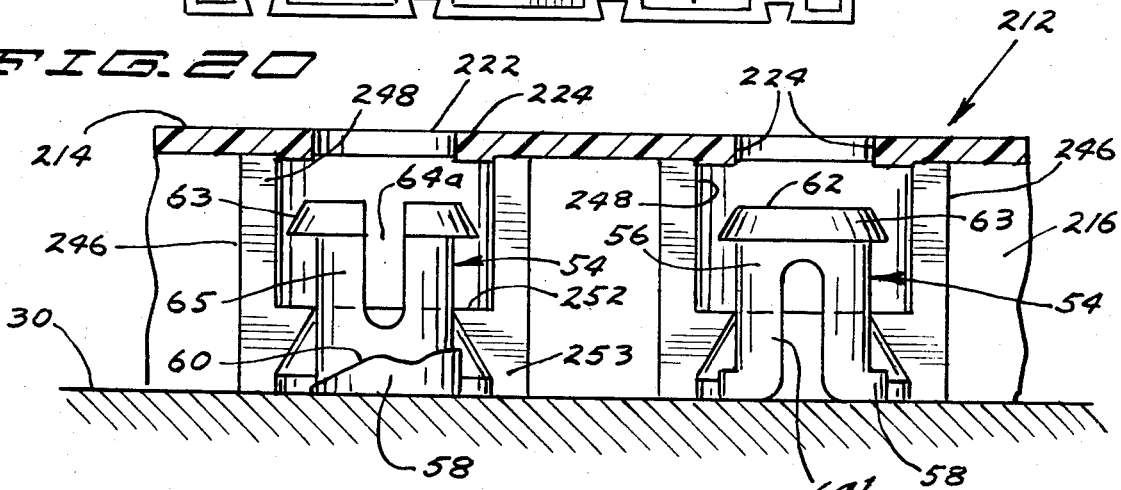
FIG. 21

ROTATABLE CAM FOR USE IN A TOY CONSTRUCTION SET

BACKGROUND OF THE INVENTION

1. Field of the Invention

This invention relates generally to toy construction sets, and pertains more particularly to a construction set comprised of various blocks that can be vertically interconnected with each other and also to a base plate.

2. Description of the Prior Art

Toy construction sets of the envisaged type are basically old and well known. Various means for interconnecting the various blocks together have been devised. Some have used separate fastening elements. Others have used various types of slip joints. One known arrangement has dealt specifically with the problem of friction when two blocks are slidably interengaged. Additionally, several ways of mounting blocks to a base plate so that they can be readily attached and detached by young children has met with a certain degree of success.

Even though commercially acceptable toy construction sets have been designed to overcome, at least to some degree, the above-mentioned problems relating to the interconnection of toy construction blocks, areas for improvement remain, especially with respect to effectively interconnecting and releasably locking toy construction blocks together in a vertical direction. More specifically, blocks comprising a toy construction set should be capable of being readily assembled and disassembled vertically, as well as laterally. Still further, certain of the blocks should desirably be attachable to a base plate (either on top of or beneath such plate), yet capable of being placed on virtually any flat surface without using an underlying base plate.

SUMMARY OF THE INVENTION

As a general object, it is an object of our invention to minimize the shortcomings of the prior art toy construction sets with respect to vertically assembling and disassembling toy blocks. In this regard, an aim of the invention is to provide a specified means for vertically interconnecting and disconnecting toy blocks, yet permitting various means to be selected and incorporated into the design of the toy blocks, as far as laterally or horizontally connecting the blocks to each other.

A more specific object of the invention is to provide a versatile toy construction set comprised of blocks of various sizes that can be assembled into different geometric configurations by children within a relatively broad age range, and, of course, disassembled as well. In this regard, an aim of the invention is to provide a variety of blocks of different sizes, yet permitting the various sizes of blocks to be oriented in various three-dimensional patterns, thereby challenging the imagination of children over a relatively large age range. In this regard, it is within the purview of our invention to provide blocks or bricks that are of various configurations and sizes; also, it is planned that the blocks be interconnected irrespective of the particular size. In this way, various arrangements can be visualized and brought into actual being by the proper choice and selection of the different blocks that are provided in a given set of such blocks.

The invention also has as an object the easy assembly and disassembly of the various blocks, even though the blocks are differently shaped, the ease of assembly and disassembly not only being concerned with the blocks themselves but also with respect to the manner in which such blocks, or at least some of the blocks, are anchored or fastened to an underlying base plate. It is an aim of the invention to utilize the same coupling means for anchoring the blocks to the base plate as is used in vertically anchoring or fastening the blocks to each other.

Another object is to provide a base plate that is provided with coupling means similar to the coupling means of the blocks, thereby enhancing the versatility of the set in that such a base plate can then be used above, as well as beneath, blocks, such as constituting the roof of a simulated building.

Yet another object of the invention is to provide a toy construction set that will be quite safe, even when in the hands of small children. In this respect, an aim of the invention is to provide a number of blocks which can be interconnected without resort to loose or non-captured pieces or parts to effect the assembly. Also, it is within the contemplation of the invention to have the assembled blocks and base plate to come apart or separate from each other when subjected to an excessive load or force, yet remain assembled under normal conditions. More specifically, it is an aim of the invention to employ rotatable coupling cams for achieving the releasable connection, the cams remaining in the blocks when the blocks are forcibly pulled apart.

Still further, an object of the invention is to provide a toy construction set comprised of a relatively large number of differently shaped blocks can be produced inexpensively by normal molding techniques. Also, it is within the scope of the invention to minimize the assembly steps at the factory. Actually, it is intended that coupling cams be readily forced into certain of the blocks and when so inserted remain captive within the blocks.

Briefly, our invention involves a toy construction set comprised of a number of blocks or bricks that have retractable coupling cams mounted therein which cams can be projected so that one end thereof is engageable with retention lugs located on a similar block. By means of a bladed hand tool, the child need only push the coupling cam as he or she rotates it so that it extends downwardly into a sub block. By twisting the tool one-quarter turn in a clockwise direction, the upper block is attached or fastened to the block immediately therebeneath. It is also planned that a base plate be provided having openings similar to the openings in the blocks, there being lugs associated with such openings that can anchor the coupling cam when the coupling cam is projected downwardly into an opening in the base plate. It is also within the purview of the invention to utilize a base plate equipped with coupling cams corresponding to the coupling cams contained in the various blocks, thereby enabling the base plate to be superimposed above a plurality of vertically connected blocks, as well as under such blocks. In this regard, the child can construct a wall, then using the base plate as a roof or cover. It is intended that the coupling cam be released intact when an excessive amount of force is applied thereto, a slot providing flexible legs that flex toward each other in order that flanges on the ends of such legs can pass by inwardly extending ears or lugs located at the end of the bore of the block to which the cam has been coupled.

Of course, by having the coupling cams held captive, even though axially shiftable and rotatable, separate pieces or parts are avoided which would pose a problem with respect to small children swallowing such pieces or parts. Even when the blocks are forcibly pulled apart, the coupling cams remain in the blocks so that they are not swallowed. While the coupling cams are indeed held captive, the assembly of such cams within the blocks at the factory is an easy task with suitably designed equipment. The various blocks, or at least certain of the blocks, can be interconnected in a lateral direction by a conventional slip joint comprised of an integral vertical projection jutting from the side of one block and slidable into an undercut complemental groove formed in the side of a second block to be connected to the first block.

BRIEF DESCRIPTION OF THE DRAWINGS

FIG. 7 is a sectional detail taken in the direction of line 7—7 of FIG. 6 so as to show more clearly the lugs on the base plate of FIG. 6;

FIG. 8 is a sectional view taken in the direction of line 8—8 of FIG. 6, the view further assisting in the understanding of the construction of the lugs used in retaining the blocks to the base plate of FIG. 6;

FIG. 9 is a top plan view of one of the blocks shown in FIG. 1;

FIG. 10 is a bottom plan view of the block appearing in FIG. 9;

FIG. 11 is a vertical sectional view taken in the direction of line 11—11 of the block appearing in FIG. 9;

FIG. 19 is a fragmentary front elevation corresponding to FIG. 17;

FIG. 20 is a bottom plan of the modified lower base plate, the view being taken in the direction of line 20—20 of FIG. 19; and FIG. 21 is an enlarged sectional detail taken in the direction of line 21—21 of FIG. 20 for the purpose of showing two of the centrally disposed coupling cams contained within one of the modified base plates when used as a foundation.

DESCRIPTION OF THE PREFERRED EMBODIMENTS

Figure 1:
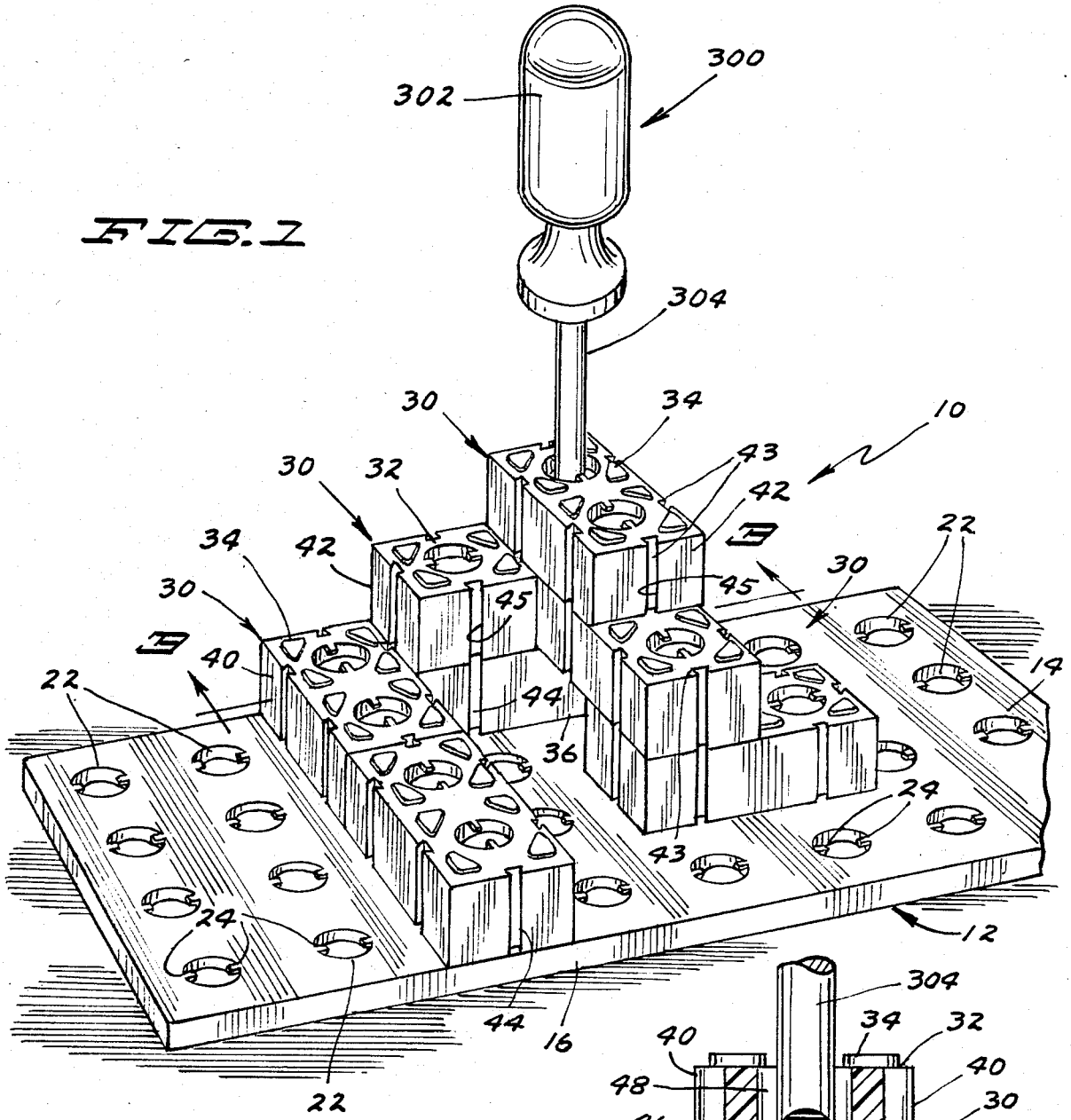
FIG. 1 is a perspective view of a number of assembled blocks exemplifying our invention, together with a bladed hand tool for effecting the interconnection of certain of the blocks.
Figure 3:
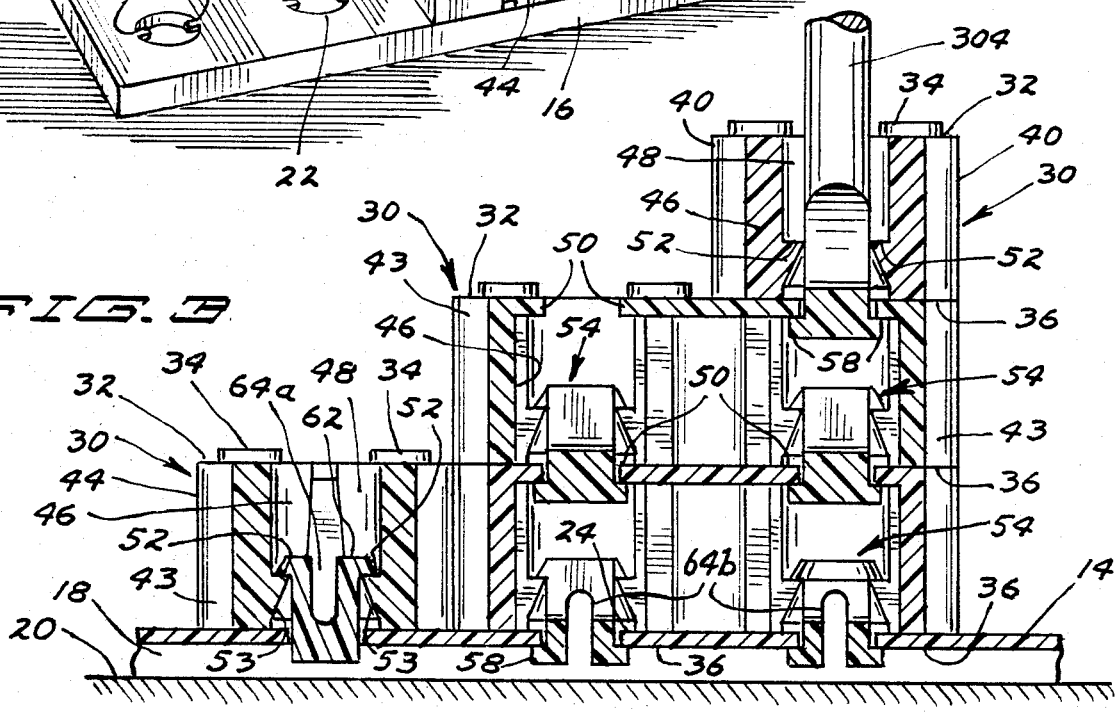
FIG. 3 is a vertical sectional view taken in the direction of line 3—3 of FIG. 1, the view illustrating the manner in which these blocks are connected in a vertical or wall-like manner with each other in accordance with our invention and also how they are connected to the underlying base plate in accordance with our invention.
Figure 2:
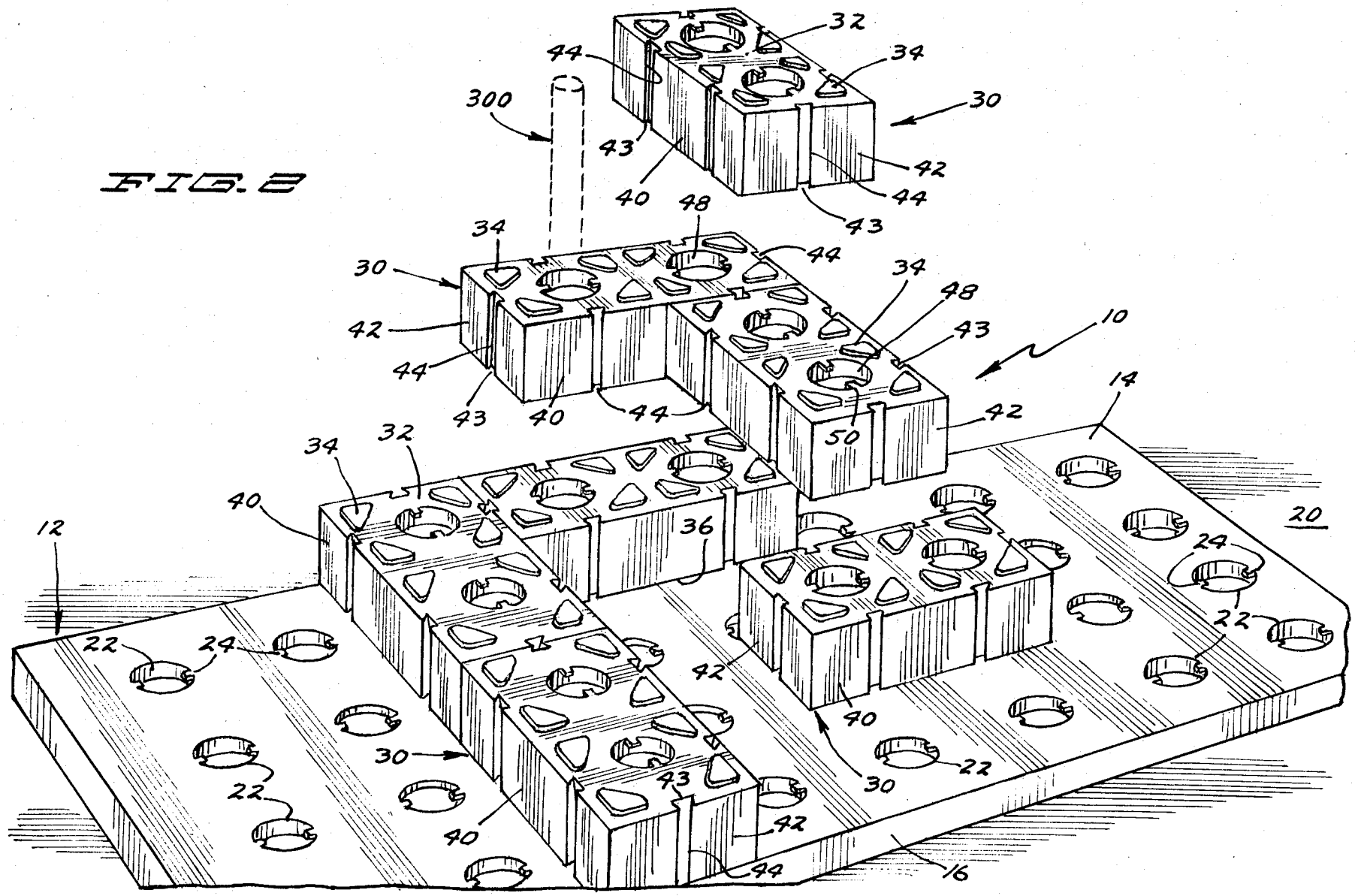
FIG. 2 is an enlarged perspective view taken in the same direction as FIG. 1, but with some of the blocks separated in an exploded manner so as to illustrate the way the blocks are assembled.

A toy construction set illustrating our invention has been denoted generally by the reference numeral 10 in FIGS. 1 and 2. Even though a limited number of blocks have been pictured in FIGS. 1 and 2, nonetheless it is believed that a sufficient variety of blocks has been shown so as to provide an understanding of our invention. More specifically, it will be appreciated that a relatively simple geometrical configuration has been selected for the purpose of illustrating our invention in FIGS. 1 and 2. A far greater number of blocks than those depicted in FIGS. 1 and 2 would normally constitute a commercial toy construction set when utilizing the teachings of our invention. The actual number of blocks is unimportant to an appreciation of the invention; instead, it is the versatile manner in which the various sizes can be interconnected to each other and to a base plate.

Accordingly, attention is first directed to a relatively simple base plate indicated generally by the reference numeral 12. The base plate 12, which can be fabricated from a suitable plastic, includes a flat panel 14 and downwardly depending side walls 16 forming a space or void 18 in conjunction with a flat surface 20, such as an ordinary table top or floor. The panel 14 is formed with a relatively large number of generally circular openings 22, each opening 22 having associated therewith integral lugs or ears 24 which are diametrically located opposite each other and which are integral with the panel 14.

Figure 17:
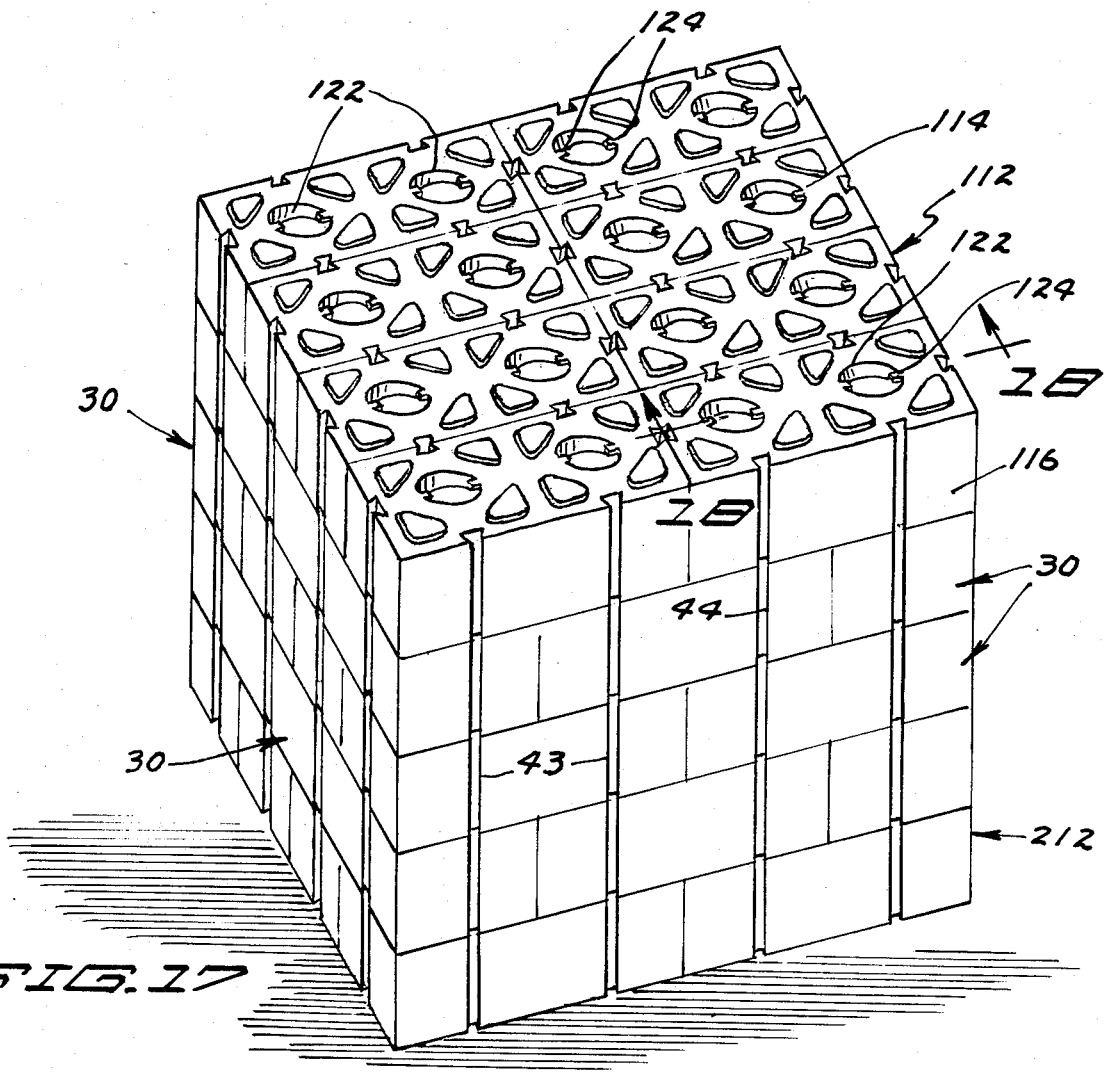
FIG. 17 is a fragmentary perspective view of a corner of a building, the view depicting two modified forms of base plate, one being used as the roof and the other as the foundation.

Whereas the toy construction set 10 in practice comprises a relatively large number of blocks, particularly a large number of blocks 30 now to be described, only a limited number of such blocks 30 have been depicted. These blocks 30 are of identical construction. The three-dimensional configuration shown in FIGS. 1 and 2 is quite arbitrary and does not represent any pattern that would have meaning to the child; in other words, the general pattern shown in FIGS. 1 and 2 is rather abstract, but does serve to illustrate the invention. A more concrete utilization of the blocks appears in FIG. 17, referred to in greater detail hereinafter. Playing an important role as far as the array of blocks appearing in FIGS. 1 and 2 is concerned would be the vertical arrangement involving the blocks 30.

Figure 4:
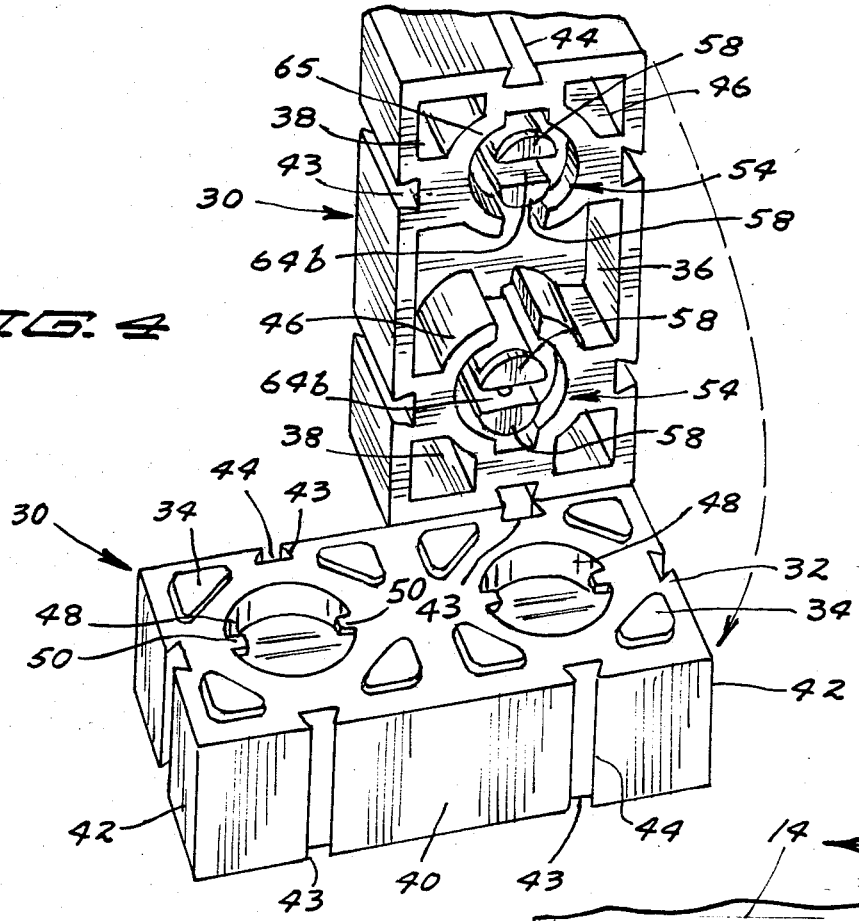
FIG. 4 constitutes what might be termed an "open sandwich" view of two blocks, the blocks being oriented relative to each other so that when the upper block is moved from its vertical position into a horizontal position certain bumps or projections on the lower block fit into correspondingly shaped recesses or cavities in the bottom of the upper block.
Figure 6:
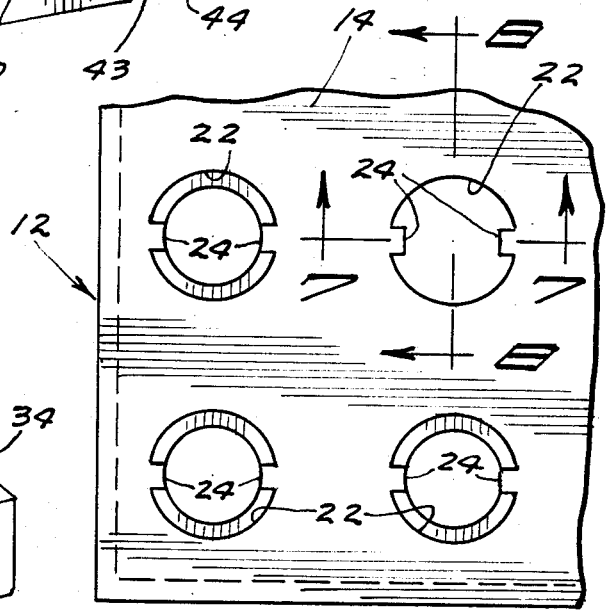
FIG. 6 is a top plan view of a corner portion of the exemplary base plate appearing in FIGS. 1–3, the view depicting the openings and the lugs associated therewith which enable the blocks to be anchored to the base plate.
Figure 5:
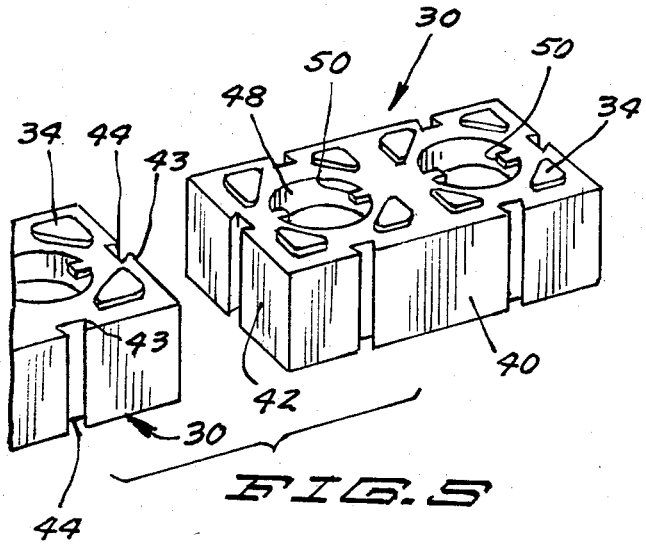
FIG. 5 is an exploded perspective view of two blocks prior to their ends being abutted together.
Figure 12:
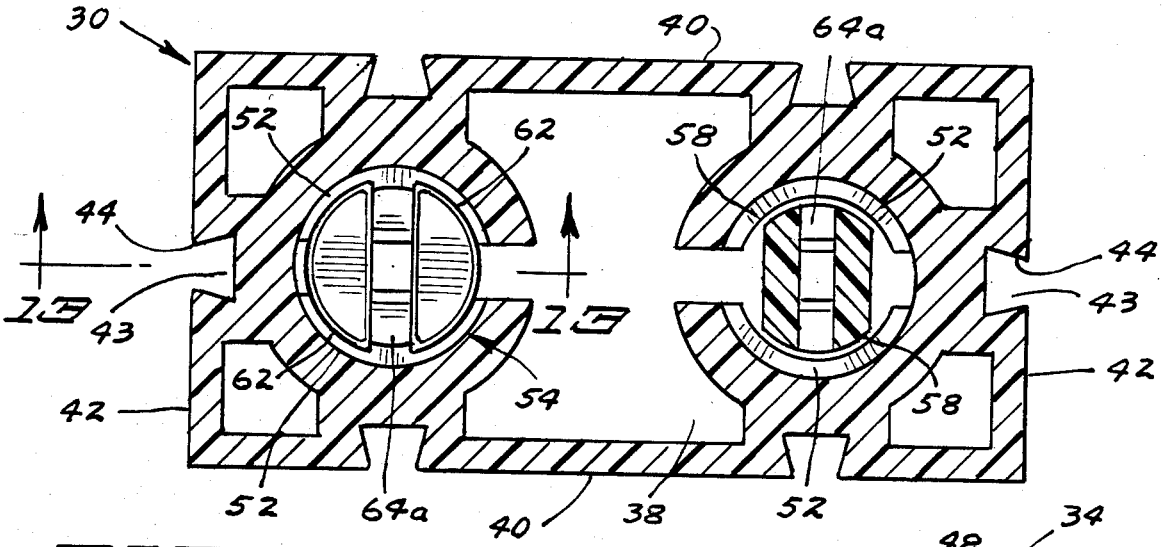
FIG. 12 is a horizontal sectional view taken in the direction of line 12—12 of FIG. 11.
Figure 13:
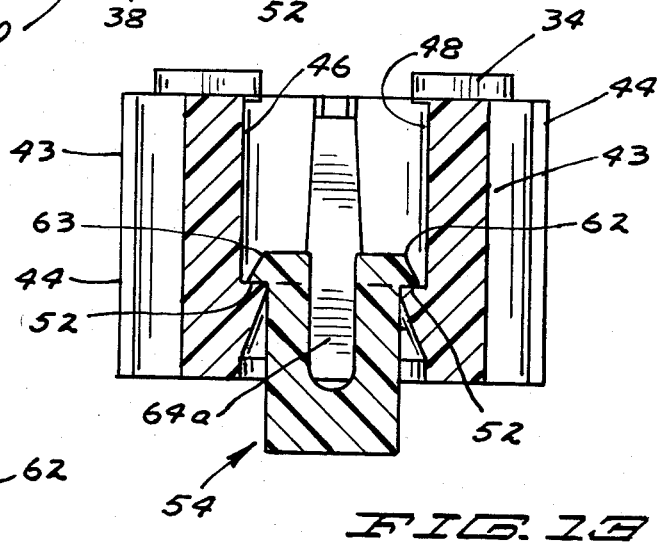
FIG. 13 is a sectional detail taken in the direction of line 13—13 of FIG. 12.
Figure 14:
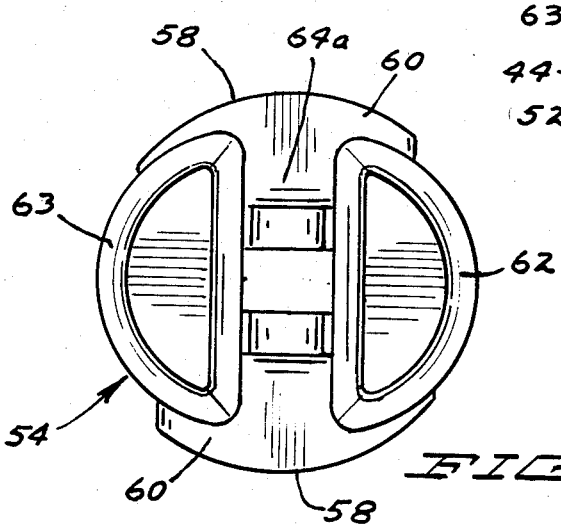
FIG. 14 is an enlarged top plan view of one of the coupling cams used in assembling the blocks together.
Figure 15:
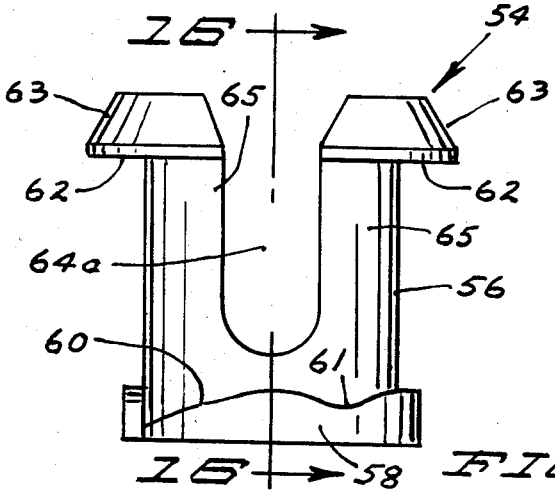
FIG. 15 is an elevational view of the coupling cam shown in FIG. 14.

Describing the blocks 30 in greater detail, the tops of the blocks 30 have been indicated by the reference numeral 32 and have a number of bumps or projections 34 which function to angularly align or register one block 30 with another block 30 therebeneath (best understood from FIG. 4). The bottoms of the blocks 30 have been denoted by the reference numeral 36 and it should be observed that a number of recesses or cavities 38 extend upwardly from the bottom 36 (also illustrated in FIG. 4). Actually, the shape of the recesses 38 complements the shape of the projections 34. Hence, when the projections 34 of one block 30 are received in the lower ends of the recesses 38 of the block 30 just above, the two blocks 30 are held in alignment, any twisting movement being precluded by reason of the projections 34 interengaging the recesses 38. It will be appreciated, though, that the child has a choice of four angular directions in which he or she can arrange any two adjacent blocks 30.

Each block 30 is formed with generally parallel side walls 40 and generally parallel end walls 42. It will be appreciated that the walls 40 (and the walls 42) are not truly parallel, being slightly tapered because of the draft needed when molding the blocks 30. In each of the side walls 40 and in each of the end walls 42 is an undercut groove 43, each groove 43 possessing a truncated appearance. It will be noted that each groove 43 has a slot 44 associated therewith. Although not appearing in the drawings, various angles, hitches, quarter rounds, rafters, corner bricks or blocks, hinges and pivot bases have one or more longitudinal tongues or dovetails jutting therefrom. The tongue or dovetail generally complements the cross section of the groove 43. In this way, such a tongue or dovetail when slidably received in a groove 43 can laterally connect two blocks 30 together or to another construction set member (not shown). The tongue or dovetail and groove arrangement is conventional, forming no part of our invention.

At this stage, attention is directed to the presence of a tubular bushing or cylindrical wall 46. Depending upon the size of the block 30, and for the sake of discussion it will be assumed that this is a double block, there would be two tubular bushings 46 contained therein. Each tubular bushing 46 has a cylindrical bore 48 extending therethrough, the bushing 46 in each instance having an upper opening corresponding to the openings 22 in the base plate 12. It will be observed that there are two diametrically opposite coupling lugs or ears 50 located at the upper end of the tubular bushing 46, that is, at the top 32 of the block 30. Still further, there are two arcuate retaining flanges or shoulders 52 formed integrally within each tubular bushing 46. As best seen in FIG. 11, the arcuate retaining flanges or shoulders 52 are located above the bottom 36 of the block 30, there being an integral beveled wall 53 extending upwardly to the flange or shoulder 52 in each instance. Actually, FIG. 11 aptly portrays the relationship between the upper lugs or ears 50 and the lower retaining flanges or shoulders 52. The purpose of the lugs 50 and the flanges or shoulders 52 will become manifest as the description progresses. At this time, it is only necessary to recognize that the flanges or shoulders 52 are recessed upwardly or inwardly within the bore 48 (being at the upper end of the beveled walls 53), whereas the lugs 50 are located at the upper end of the bore 48.

Figure 16:
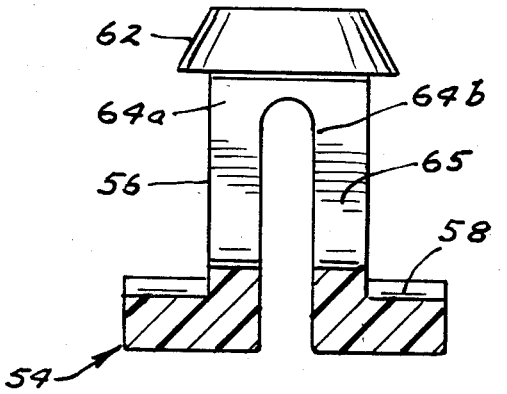
FIG. 16 is a sectional view taken in the direction of line 16—16 of FIG. 15.

Of importance in practicing our invention is a coupling cam 54 which is clearly shown in FIGS. 11 and 13–16. There is a coupling cam 54 axially shiftable and rotatable in each cylindrical bore 48. The coupling cam 54, which is of suitable plastic material such as polyoxymethylene (acetal), in each instance includes a generally cylindrical body 56. At the lower end of the body 56, as viewed in FIGS. 11 and 15, and to some extent in FIG. 16, are a pair of flanges 58, the flanges extending diametrically in opposite directions. Each flange 58 has formed on its upper side a sloping cam surface 60 formed with a depression or notch at 61, the contour of the cam surface 60, together with the depression or notch 61, being best understood from FIG. 15. At the upper end of the body 56 of each cam 54 are flanges 62 which extend at right angles with respect to the lower flanges 58, although at different elevations. The flanges 62 have beveled edges 63.

Each cam 54 has formed therein a slot 64*a* extending downwardly from its upper end, the slot 64*a* performing a dual purpose. First, the slot 64*a* provides a recess into which the blade of a tool can be inserted so that the cam 54 can be rotated or twisted when fastening two blocks 30 to each other, and secondly the slot 64*a* permits the flexing together during assembly at the factory of what amounts to a pair of legs 65 forming the generally cylindrical body 56, the beveled wall 53 acting to cam the legs 65 toward each other during the upward insertion of the cam 54 into the bore 48; stated somewhat differently, the upper end of the slot 64*a* becomes narrower during this assembly step. Each cam 54 also is formed with a second slot 64*b* extending upwardly from its lower end, the slots 64*a* and 64*b* being at 90° relative to each other. It should be mentioned that when an excessive amount of force is applied to a block 30 when coupled to another block 30 by means of a cam 54, an override function is performed in that the slot 64*b* will become sufficiently narrower so that the two blocks 30 (or whatever number is subjected to the overload) will separate by virtue of the flanges 58 being forced closer together. Additional description of the coupling cam 54, particularly the role played thereby, is perhaps better reserved for later discussion.

Our toy construction set 10 additionally includes a hand tool 300 having a handle 302 and an integral blade 304.

The base plate 12 is of comparatively simple construction and is presented solely as an illustration of what could be provided in a basic construction set 10. In practice, a more versatile base plate 112 is included in the set 10. As can be perceived from FIGS. 17 and 18, the more elaborate base plate 112 is employed as the roof of a building utilizing a plurality of blocks 30 interconnected in a wall-like fashion by means of the coupling cams 54 contained therein. While the relatively simple base plate 12, which is illustrative only, underlies the blocks 30, it will be appreciated that the more versatile second base plate 112 would be supplied in lieu of the base plate 12.

Describing the base plate 112 in greater detail, it is to be observed that it includes a flat panel 114 having downwardly depending side walls 116. As with the base plate 12, the base plate 112 is provided with a number of generally circular openings 122, each opening 122 having associated therewith integral lugs or ears 124.

Figure 18:
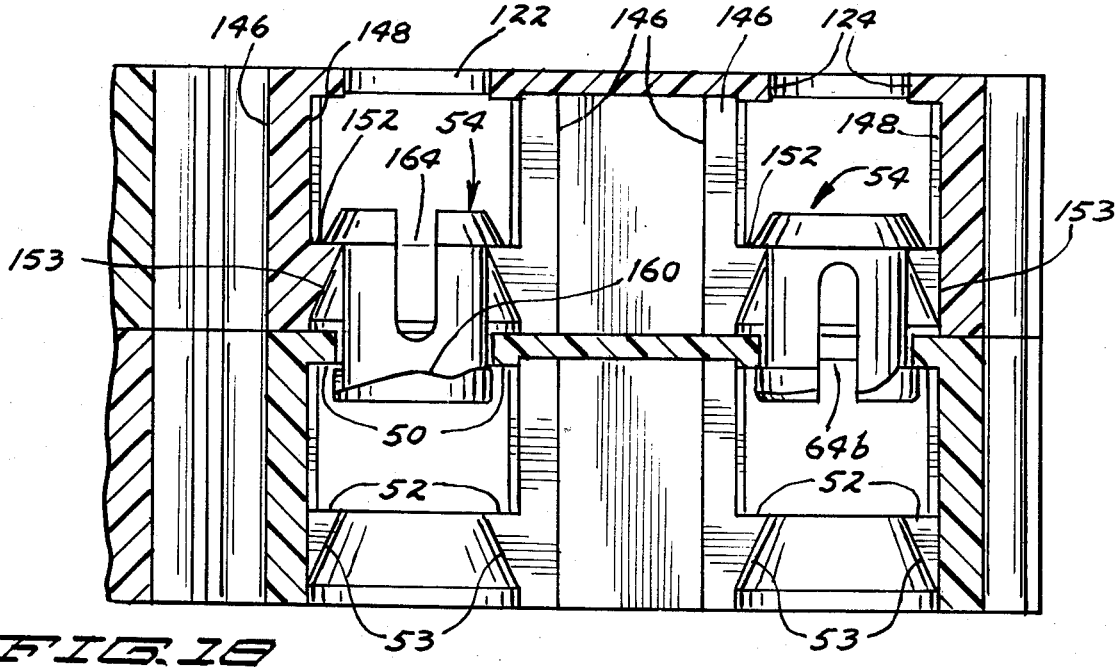
FIG. 18 is an enlarged sectional detail taken in the direction of line 18—18 of FIG. 17 for the purpose of showing two of the peripherally disposed coupling cams contained within one of the modified base plates when used as a roof.

The base plate 112 includes a number of coupling cams 54. Two such cams 54 appear in FIG. 18, each being disposed in a tubular bushing or cylindrical wall 146 having a cylindrical bore 148. Within the cylindrical wall 146, in each instance, is a flange or shoulder 152 and a beveled wall 153. The cam 54 at the left in FIG. 18 is depicted in an uncoupled condition, whereas the cam 54 at the right is shown coupled, having been pushed downwardly and twisted through 90° by means of the tool 300 (not illustrated in this figure but shown in FIG. 1 as previously mentioned).

The base plate 112 (used as a roof in FIG. 17) contains only peripherally located cams 54. The base plate 212 (used as a foundation in FIG. 17) also contains only peripherally located cams 54. It will be noted that the base plate 212 includes a flat panel 214 having downwardly depending side walls 216. As with the base plates 12 and 112, the base plate 212 is provided with a number of generally circular openings 222, each opening 222 having associated therewith integral lugs or ears 224.

As indicated above, the base plate 212 includes a number of peripherally located coupling cams 54. In an effort to picture this, it should be noted that the sectional line 21–21 is through two peripherally located openings 222. Each cam 54 is disposed in a tubular bushing or cylindrical wall 246 having a cylindrical bore 248. Within the cylindrical wall 246, in each instance, is a flange or shoulder 252 and a beveled wall 253.

Inasmuch as the base plate 212 is resting on a flat surface, such as that labeled 20, both cams 54 in FIG. 21 are uncoupled, the cams 54 merely gravitationally engaging the surface 20. The cams 54 in FIG. 21, however, are oriented at 90° with respect to each other.

Having presented the foregoing information, it is believed that the manner in which our toy construction set 10 is used is readily understandable. Nonetheless, in order that the full benefits of our invention can be appreciated, various assembling procedures will now be described.

Initially, there is only one simple assembling procedure required at the factory. This involves the insertion of each coupling cam 54 in the bore 48 (or 148, 248) of the particular tubular bushing 46 (or 146, 246) it is to be received in. It has previously been mentioned that the slot **64*a* in the body 56 of the coupling cam 54 enables a dual function to be performed. Thus, when an individual coupling cam 54 is urged upwardly, actually downwardly when the cam 54 is being inserted at the factory with appropriate equipment (not shown) because the block 30 would then be inverted with its bottom 36 uppermost, it is forced past the retaining flanges 52 (or 152, 252). The slot 64*a* permits the body 56 to flex together by reason of the beveled wall 53 (or 153, 253) so as to allow the upper flanges 62, facilitated by the beveled edges 63, to pass by the flanges 52. Of course, the coupling cam 54 cannot move completely upwardly (downwardly when the block 30 is inverted) and out of the tubular bushing 46 (or 146, 246) because of the interference of the cam flange 58 with the inwardly extending flange 52 and the lugs or ears 50 (or 124, 224). Consequently, each of the coupling cams 54 is held captive within its particular cylindrical bore 48 (or 148, 248) by virtue of the lugs 50 (or 124, 224) at the top 32 and the flanges 52 at the bottom 36. The coupling cam 54 is both freely rotatable and vertically movable (to a limited extent) within its associated tubular bushing 46 (or 146, 246**), once it has been inserted in the manner described above.

Also, it should be appreciated that the cam 54 is shiftable axially between the upper lugs 50 (or 124, 224) and the lower flanges 52. It is when the flanges 62, which constitute what might be termed a head on the body 56 of the cam 54, bear against the upper surfaces of the retaining flanges 52 (or 152, 252) that the lower end of the coupling cam 54 projects beneath the bottom 36 (or beneath the plate 112, 212), doing so to the extent that the flanges 58 having the cam surfaces 60 thereon are positioned beneath the lugs or ears 50 (or 124, 224) of the particular block 30 beneath the block 30 that is to be mated therewith. Actually, the lugs or ears 50 then reside in the depressions or notches 61. Once the cam 54 is twisted through 90° by means of the hand tool 300, then the cam surfaces 60 are angularly oriented in an obstructive relation with the lugs or ears 50 of the block 30 immediately below. The notches 61 serve as detents to maintain a releasable engagement and proper alignment with the lugs 50. However, the notches 61 are relatively shallow and their sloping edges permit an override to occur whenever sufficient torque is applied to the hand tool. It will be understood that only a slight amount of pressure need be applied on the handle 302 of the hand tool 300 in order to cause the lower end of the blade 304 to engage in the slot **64*a* of a particular cam 54, thereby causing the cam 54 to be shifted downwardly to cause the lower end having the flanges 58 thereon project beneath the bottom 36 of the particular block 30. Actually, it is intended that the cam 54 move gravitationally downward of its own accord to cause the flanged lower end to project sufficiently prior to effecting a connection of one block 30** to another.

Inasmuch as the recesses 38 are dimensioned so as to receive the projections 34 therein, and due to the symmetry thereof, it should be readily apparent that the child has a choice of angles when connecting two blocks 30 together; they can be at 90° or at 180°.

Of interest, although the hand tool 300 does not appear in FIG. 11, it will be seen from the left portion of FIG. 11 that the lower end of the coupling cam 54 there shown projects beneath the bottom 36 of the particular block 30 appearing in FIG. 11.

Having mentioned the capability of having the lower end of the cam 54 project beneath the bottom 36 of the block 30, as seen in FIG. 11, it should be mentioned that when so projecting downwardly, the same type of engagement or interconnection can be effected with the base plate 12 (or 112, 212), more specifically by having the lower end of the coupling cam 54 project downwardly through a given opening 22 so that when twisted through 90° there will be an obstructive relation created between the lugs or ears 24 (or 124, 224) on the panel 14 (or 114, 214) which are associated with a given opening 22 (or 122, 222). Hence, the same dimensional arrangement for connecting one block 30 to another block 30 is used for connecting one block 30 to the base plate 12 (or 112, 212) or vice versa. It will be appreciated that the cam surface 60, when the cam 54 is twisted more than 90° will flex the ears 58 sufficiently to permit such a degree of twisting without any breakage occurring. It will be recognized that the slot **64*b*** plays an important role in such release.

It is not necessary that a block 30 be connected to the base plate 12. The retractability of each coupling cam 54 permits the cam 54 to remain completely within the tubular bushing 46. This happens by a slight amount of friction or if a particular block 30 is placed on a flat surface, such as that labeled 20, then the cam 54 if projecting downwardly is urged upwardly into a recessed relationship within the particular cylindrical bore 48, all as clearly evident from the right side of FIG. 11.

It will be appreciated that in order to disconnect a particular block 30, the reverse procedure is resorted to. In other words, if both coupling cams 54 contained in a given block 30 have been employed to effect a connection, then both will be twisted or rotated 90° in order to achieve a release of that block. It will be recognized that it is when the flanges 62 are at 90° with the lugs 50 that separation is easily achieved, for this perpendicular relationship obviates any interference between the lugs 50 and the flanges 62. The same procedure is employed with respect to disconnecting a block 30 from either the base plate 12 or the base plate 112, 212.

It should perhaps be explained that in practice the blade 304 of the tool 300 is tapered, the degree of taper being sufficient to provide a slight wedging action and resulting frictional retention of the blade 304 in the slot 64*a* so that the particular cam 54 can be readily retracted upwardly from, for example, the position at the left in FIG. 11 to the position at the right in this figure or from the position at the right in FIG. 18 to the position at the left in this latter figure. After completing the uncoupling, the tool 300 can readily be pulled upwardly to dislodge the blade 304 from its frictional engagement with the cam 54

It is important to recognize that irrespective of the number of blocks 30 that are assembled in providing a geometrical configuration, should a sufficient amount of force be applied, there is an unaided or spontaneous release or detachment of one block 30 from another that occurs (or from whichever base plate 12, 112 or 212 that is being used). As far as the coupling cams 54 are concerned, the cam flanges 58 will flex inwardly sufficiently so that the flanges 58 pass upwardly past the lugs or ears 50, the presence of the lower notch 64*b* allowing this to occur when necessary. Not only are the blocks releasable from each other, but owing to the similarity of connection between certain of the blocks and the underlying base plate 12 or 212 (or overlying base plate 112), the flanges 58 on the coupling cams 54 can pass upwardly to effect a release or detachment from the base plate 12 or 212 (or the base plate 112 from the blocks 30 therebeneath), the notch 64*b* under these conditions also narrowing so that the flanges 58 readily move by the inwardly directed lugs or ears 24 (or 124, 224) in effecting a release under a sufficiently excessive load.

Recapitulating, it should be readily apparent that the various blocks 30 can be assembled in various three-dimensional configurations, either on any of the base plates 12, 112 or 212, or under either of the base plates 112 or 212, or on a flat surface, such as that labeled 20. It is preferable, though, to utilize the base plate 12, 112 or 212 which can be provided in various sizes, depending upon the size and complexity of the construction set 10. It will be appreciated that the geometrical shapes can be in the form of a building, a bridge, a vehicle and many other shapes with which a child would be familiar.

We claim:

1. In a toy construction set, a plurality of interconnectible members, at least one of said members having a cylindrical bore therein, a rotatable coupling cam completely contained in said bore, said cam behind axially shiftable in first and second directions, means holding said cam captive within said bore, said holding means permitting an end portion of said cam to project in said first direction from said one member when said cam has been shifted sufficiently in said first direction, so that said end portion projects from said bore, said plurality of members including at least another member having an opening for receiving therein said projecting end portion when said cam has been shifted sufficiently in said first direction and having means associated with said opening capable of providing obstructive engagement with said end portion when said end portion is projecting from said one member after said cam has been shifted sufficiently in said first direction and is rotated into said obstructive engagement.

2. In a toy construction set as defined in claim 1 wherein said one member constitutes a block and said another member constitutes a base plate.

3. In a toy construction set as defined in claim 1 wherein said one member and said another member constitute first and second blocks.

4. In a toy construction set as defined in claim 1 wherein said end portion is provided with an outwardly extending member and said means associated with said opening includes an inwardly extending member, said obstructive engagement occurring when said outwardly extending member is rotated into engagement with said inwardly extending member.

5. In a toy construction set as defined in claim 1 wherein said end portion is provided with outwardly extending flanges and said means associated with said opening includes inwardly extending lugs, said obstructive engagement occurring when said outwardly extending flanges are rotated into angular alignment with said inwardly extending lugs.

6. In a toy construction set as defined in claim 5 wherein said bore forms an additional opening, said holding means including inwardly extending lugs associated with said additional opening and flanges extending into said bore at a location in said bore spaced from lugs associated with said additional opening, said coupling cam being engageable with said lugs when axially shifted in said bore in said second direction which is a direction opposite to said first direction and being engageable with said inwardly extending flanges when shifted sufficiently in said first direction.

7. A toy construction set as defined in claim 6 wherein said inwardly directed flanges are disposed within said bore and spaced from one end thereof to determine the distance said end portion projects.

8. A toy construction set as defined in claim 7 wherein said distance is only sufficient to enable said outwardly extending flanges on the portion of said cam to effect said obstructive engagement with inwardly extending lugs associated with said first-mentioned opening.

9. A toy construction set as defined in claim 8 wherein said coupling cam includes additional outwardly extending fingers at the end thereof remote from the outwardly extending flanges on said end portion, said additional outwardly extending flanges engaging the inwardly extending lugs associated with said additional opening when said cam is sufficiently retracted into said bore.

10. A toy construction set as defined in claim 9 wherein said coupling cam has a slot between said additional outwardly extending flanges which extends axially toward said end portion.

11. In a toy construction set, plurality of interconnectible blocks, certain of said blocks including an axially shiftable and rotatable coupling cam, said cam in each instance being shiftable from a fully retracted position within the block with which it is associated to a partially projected position, said certain blocks also having means engageable by the cam of an adjacent block when the cam of said adjacent block is in its said partially projected position.

12. In a toy construction set as defined in claim 11 wherein the toy construction set includes a base plate, said base plate having respective means engageable by the cam of an adjacent block when the cam of said adjacent block is in its said partially projected position.

13. In a toy construction set as defined in claim 12 wherein said base plate includes a plurality of axially shiftable and rotatable coupling cams.

14. In a toy construction set, a plurality of interconnectible blocks, first of said plurality of blocks including a coupling cam for attaching said first block to a second block of said plurality of blocks, and a third block of said plurality of blocks including means for selectively attaching said third block to said first block and said second block, said second block including a tubular bushing having inwardly extending lugs, said cam having flanges thereon engageable with said lugs.

15. In a toy construction set, first and second blocks wherein each block includes a tubular bushing having a cylindrical bore extending therethrough, a pair of diametrically located lugs extending toward each other at one end of said bore, a pair of diameterically located flanges extending toward each other within said bore and recessed with respect to the other end of said bore, a coupling cam shiftably contained in said bore, a first pair of diametrically located flanges extending outwardly in opposite directions from one end of said cam, a second pair of diametrically located flanges extending outwardly in opposite directions from the other end of said cam, said first and second oppositely extending flanges being spaced an axial distance less than the distance between said lugs and said recessed flanges and said first pair of flanges on said cam being obstructively engageable with said lugs when said cam is shifted in one direction and said second pair of flanges on said cam being obstructively engageable with said recessed flanges when shifted in an opposite direction so that said cam is held captive in said bore between said lugs and said recessed flanges, said lesser distance between said first and second oppositely extending flanges permitting said cam to be axially shifted within said bore so that said second oppositely extending flanges project axially from the first block so that said second oppositely extending flanges can be obstructively engaged with the lugs of said second block when said cam is rotated to thereby interconnect said first and second blocks.

16. A toy construction set as defined in claim 15 wherein said second oppositely extending flanges are formed with sloping cam surfaces.

17. A toy construction set as defined in claim 16 in which said cam surfaces have notches formed therein in which said lugs reside when said cam is rotated to interconnect said first and second blocks.

18. A toy construction set as defined in claim 16 in which said cam has a slot between said second oppositely extending flanges, said slot extending from said other end of said cam toward its said one end so that said second flanges can flex toward each other to effect the release of the cam from said cylinder bore when subjected to an excessive amount of force.

19. A toy construction set as defined in claim 18 in which said cam has a second slot between said first oppositely extending flanges, said second slot extending from said one end of said cam toward its said other end so that said first flanges can flex toward each other to facilitate factory insertion of said cam into said cylindrical bore.

20. For use in a toy construction set, a rotatable cam comprising a body portion having a slot extending from one end thereof toward the other end thereof, said body portion having a pair of oppositely directed flanges at said one end, each of said flanges having a cam surface on the side thereof facing toward said other end of the body portion, said body portion having a second pair of oppositely directed flange at its said other end, said second flanges being generally perpendicular to said first flanges.

21. A rotatable cam for use in a construction set as defined in claim 20 in which said body portion has a second slot extending from its said other end toward its said one end, said second slot being generally perpendicular to said first first slot.

22. A rotatable cam for use in a construction set as defined in claim 21 in which the cam is formed from a plastic material.

23. A rotatable cam for use in a construction set as defined in claim 22 in which said plastic material acetal.

* * * * *